US007241344B2

(12) United States Patent
Worsham et al.

(10) Patent No.: US 7,241,344 B2
(45) Date of Patent: Jul. 10, 2007

(54) APPARATUS AND METHOD FOR ELECTROSTATIC SPRAY COATING OF MEDICAL DEVICES

(75) Inventors: Robert Worsham, Somerville, MA (US); James G. Hansen, Coon Rapids, MN (US)

(73) Assignee: Boston Scientific Scimed, Inc., Maple Grove, MN (US)

( * ) Notice: Subject to any disclaimer, the term of this patent is extended or adjusted under 35 U.S.C. 154(b) by 288 days.

(21) Appl. No.: 10/774,483

(22) Filed: Feb. 10, 2004

(65) Prior Publication Data

US 2005/0175772 A1 Aug. 11, 2005

(51) Int. Cl.
*B05B 5/025* (2006.01)

(52) U.S. Cl. ..... 118/629; 118/620; 118/DIG. 11

(58) Field of Classification Search ..... 118/620, 118/621, 629, 630, DIG. 11, 306, 317, 307, 118/500, 503, 505; 427/458, 457, 466, 471, 427/472, 476, 2.24, 2.1, 2.25, 2.28
See application file for complete search history.

(56) References Cited

U.S. PATENT DOCUMENTS 2,658,009 A * 11/1953 Ransburg ..... 427/483
2,658,472 A * 11/1953 Ransburg ..... 118/626
2,759,763 A * 8/1956 Juvinall ..... 239/3
3,712,833 A * 1/1973 Fichaux ..... 134/1
5,091,205 A 2/1992 Fan
5,181,661 A * 1/1993 Wollard ..... 239/704
5,190,588 A * 3/1993 Matushita et al. ..... 118/635
6,096,391 A * 8/2000 Muffoletto et al. ..... 427/580

* cited by examiner

*Primary Examiner*—Yewebdar Tadesse
(74) *Attorney, Agent, or Firm*—Kenyon & Kenyon LLP

(57) ABSTRACT

An apparatus and method for electrostatic spray deposition of small targets, such as medical devices like stents. The apparatus includes a target holder which applies a first electrical potential to the target, and an electrostatic dispensing nozzle which applies a second potential sufficient to attract the coating fluid from the nozzle toward the target. Because the entire dispensing nozzle is conductive, the coating fluid may receive a greater charge than may be obtained with internal electrode-type nozzles. Electrostatic attraction of the coating fluid to the target is enhanced by the combination of higher charge density imparted to the coating fluid by the conductive nozzle, and application of a momentary voltage spike to the target to provide consistent conductivity between the target and its holder, thereby ensuring the target is presents the full first potential applied to the holder. The voltage spike may also be used independently of the conductive nozzle.

4 Claims, 2 Drawing Sheets

APPARATUS AND METHOD FOR ELECTROSTATIC SPRAY COATING OF MEDICAL DEVICES

FIELD OF THE INVENTION

The field of the present invention is application of coatings to target devices, such as medical devices. More specifically, the present invention is directed to the field of electrostatic spraying of a fluid, such as a therapeutic or protective coating fluid, to apply a coating to a target device.

BACKGROUND

Medical implants are used for innumerable medical purposes, including the reinforcement of recently re-enlarged lumens, the replacement of ruptured vessels, and the treatment of disease such as vascular disease by local pharmacotherapy, i.e., delivering therapeutic drug doses to target tissues while minimizing systemic side effects. Such localized delivery of therapeutic agents has been proposed or achieved using medical implants which both support a lumen within a patient's body and place appropriate coatings containing absorbable therapeutic agents at the implant location. Examples of such medical devices include catheters, guide wires, balloons, filters (e.g., vena cava filters), stents, stent grafts, vascular grafts, intraluminal paving systems, implants and other devices used in connection with drug-loaded polymer coatings. Such medical devices are implanted or otherwise utilized in body lumina and organs such as the coronary vasculature, esophagus, trachea, colon, biliary tract, urinary tract, prostate, brain, and the like.

The delivery of expandable stents is a specific example of a medical procedure that may involve the deployment of coated implants. Expandable stents are tube-like medical devices, typically made from stainless steel, Tantalum, Platinum or Nitinol alloys, designed to be placed within the inner walls of a lumen within the body of a patient. These stents are typically maneuvered to a desired location within a lumen of the patient's body and then expanded to provide internal support for the lumen. The stents may be self-expanding or, alternatively, may require external forces to expand them, such as by inflating a balloon attached to the distal end of the stent delivery catheter.

The mechanical process of applying a coating onto a stent or other medical device may be accomplished in a variety of ways, including, for example, spraying the coating substance onto the device, so-called spin-dipping, i.e., dipping a spinning device into a coating solution to achieve the desired coating, and electrostatic fluid deposition, i.e., applying an electrical potential difference between a coating fluid and a target to cause the coating fluid to be discharged from the dispensing point and drawn toward the target.

Common to these processes is the need to apply the coating in a manner to ensure that an intact, robust coating of the desired thickness is formed on the stent. Electrostatic coating has been employed to obtain coated medical devices, particularly in applications where the coating fluid viscosity is very low, for example, in the vicinity of one centipoise. For example, in U.S. patent application Ser. No. 10/409,590, filed Apr. 9, 2003, the disclosure of which is hereby incorporated in its entirety by reference, a coating application apparatus and method is described in which a target, such as a stent, is held by a target holder at a first electrical potential. A second potential is applied to an electrode in contact with the coating fluid within a coating fluid spray dispenser to impart a charge to the coating fluid.

The charged coating fluid is then accelerated by electrostatic attraction from the spray dispenser toward the target device.

The foregoing approach to electrostatic coating application provides highly uniform coating application, along with other benefits, such as precision control of coating deposition rates and highly efficient production when incorporated into automated device handling systems. However, to maximize efficient utilization of the coating material with this approach, sufficient electrostatic attraction of the coating fluid particles to the target should be provided in order to obtain a high rate of coating deposition, and thus minimize coating waste (i.e., coating that fails to adhere to the target). Obtaining sufficient electrostatic attraction between the target and the coating fluid spray should consist of both (i) good conductivity between the target holder and the target to ensure the first potential applied to the target holder is fully transferred to the target, and (ii) ensuring the coating fluid picks up enough charge as it passes through the sprayer nozzle such that the fluid particles that emerge from the sprayer are sufficiently charged to be attracted to the target.

Empirical experience has shown that the target holder-to-target conductivity can vary significantly on an individual target-to-target basis. Such variability could be detrimental to obtaining consistent coating distribution and thickness on the target. Experimentation with the attachment of high-conductivity materials to the target, such as gold or gold-plated electrodes, to enhance holder-to-target conductivity has not completely eliminated the variability in conductivity. As a result of the experimentation, however, it was discovered that oxide formed on the surfaces of a metal target is a principal source of the inconsistent holder-to-target conductivity, and that elimination of the oxidation at the holder-to-target contact points ensures the target is held at the same potential as its holder to better attract the charged coating fluid spray.

With regard to ensuring a sufficient charge is imparted to the coating fluid, some electrostatic nozzles typically are constructed with a non-conductive housing containing an internal electrode, and the coating fluid is charged by applying the second electrical potential voltage to the internal electrode. The internal electrode arrangement is disadvantageous, however, as it limits the amount of charge than may be efficiently transferred to the coating fluid spray. Moreover, an internal electrode arrangement increases the complexity of the internal arrangements of the nozzle, while the amount of space available for the internal electrode is limited by other nozzle internal parts. There also must be provided an effective electrode-to-dispenser nozzle seal to prevent leakage of the coating fluid from the electrode/nozzle interface. Other disadvantages of internal electrode-type nozzles are increased dispenser manufacturing costs, and increased difficulty in properly cleaning the electrode and the other parts within the dispenser. Further, as a consequence of the internal electrode dispensing nozzle's internal geometry limiting electrode surface area, the amount of charge transfer from the internal electrode to the coating fluid is also limited. This in turn lowers the coating fluid's ionization, which decreases its attraction to the target. Combined with decreased electrical potential at the target due to varying holder-to-target conductivity, the coating fluid's attraction to the target is lower than desired, which decreases the coating deposition rate on the target because a greater fraction of the coating spray passes by or through the target without depositing thereon. The result is a lower overall coating utilization rate, and undesired waste of coating fluid.

SUMMARY OF THE INVENTION

The present invention is directed to an improved and simplified electrostatic spray coating apparatus and method.

In certain embodiments of the invention, there is a provided an apparatus in which the coating fluid spray dispenser outlet nozzle comprises an electrically conductive material, and the second electrical potential is applied directly to the outlet nozzle to cause the coating fluid to be accelerated toward the target. This approach to electrostatic coating spray permits the entire dispenser and outlet nozzle to serve as the electrode for application of the second potential to the coating fluid, increasing the available electrode surface area within the nozzle in contact with the coating fluid, and thereby improving the coating fluid ionization. The increased ionization increases the fraction of coating spray attracted to the target.

Additionally or alternatively, in certain embodiments of the invention, the coating fluid's electrostatic attraction to the target also may be enhanced by improving the target holder-to-target conductivity (and thereby, improving the target holder's ability to conduct a greater first potential to the target) by applying a brief high voltage surge at very low-amperage to the holder's circuit, thereby eliminating oxidation on the surface of the target at the target holder-to-target contact points.

The present invention provides the desired target with contact point uniformity and increased electrical attraction, thus improving coating material transfer to a target in a more cost-efficient manner.

DETAILED DESCRIPTION

Figure 1:
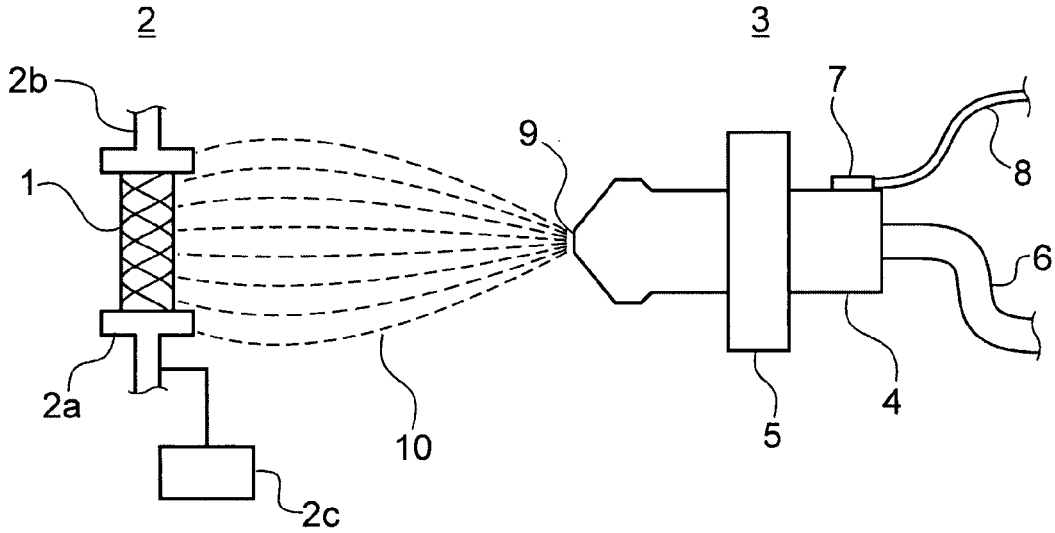
FIG. 1 is a schematic view of a first embodiment of an electrostatic spray coating fluid delivery apparatus in accordance with the present invention.

A first embodiment of the present invention is illustrated in FIG. 1. In this embodiment, a target 1 to be coated with a coating fluid is held by target holder 2, comprising a base portion 2*a* and a top portion 2*b*. Target 1 in this instance is a stent that is to be coated with a therapeutic material. In addition to holding stent 1 in a position suitable for coating application, stent holder base portion 2*a* functions as an electrode, and is maintained at a first electrical potential. Stent holder 2 may hold stent 1 by any number of means, such as by the stent holders described in U.S. patent application Ser. No. 10/198,094, the disclosure of which is hereby expressly incorporated by reference herein.

In this embodiment, stent holder 2 and stent 1 are held at a ground potential during electrostatic spraying of the coating fluid toward stent 1. In order to enhance the electrostatic attraction of the coating fluid to the target, after stent 1 is seated on stent holder 2 and before initiating the coating fluid spray, a very short high voltage spike may be delivered through the circuitry of stent 1 and stent holder 2 to remove the oxidation on stent 1 at its contact points with stent holder 2. Such a voltage spike may be sent from a spark discharge-type generator 2*c* to stent holder base portion 2*a*, and through stent 1 and stent holder top portion 2*b* to ground (ground connection not illustrated). Optionally, the high voltage spike may be omitted altogether if it is determined that holder-to-target conductivity is already sufficiently high to obtain consistent coating thickness.

Alternative means for application of the momentary high voltage spike to the target may be used, as long as the high voltage spike is applied in a manner that ensures good conductivity between the holder and the stent. For example, rather than providing ground through the present embodiment's separate "T"-shaped holder top portion 2*b*, a one-piece target holder 2*a* may be employed, and a separate grounded conductor may be momentarily placed in contact with the side of the target before the voltage spike is applied. Such an arrangement would be particularly well suited to automated device handling processes. For instance, as a target holder on an endless conveyer belt moves toward a coating fluid application station, a flexibly-mounted grounding strap may protrude into the target's path and touch the target while the oxidation-removing voltage spike is simultaneously applied.

In this embodiment, the high voltage spike is supplied by spark discharge apparatus 2*c*. Because the voltage spike associated with the spark discharge is very short-lived, the current generated to remove the oxidation at the holder-stent contact points is only in the micro-amp range. Accordingly, removal of the oxide layer from the stent is accomplished without burn marks on the target stent, resulting in improved conductivity. The spark discharge apparatus may, for example, cause a spark to bridge a spark gap away from the target at a voltage on the order of 5,000 Volts in order to provide a voltage spike impulse at the target contact points. The spark discharge apparatus 2*c* may be a separate unit as shown in FIG. 1, or, with appropriate switching circuitry, the voltage required to generate the spark discharge may be supplied by the same voltage generator that supplies a charge to the coating fluid. Alternatively, the spark generator may be a piezoelectric spark generator.

Proximate to stent 1 and holder 2 is a coating fluid spray dispensing device 3, schematically illustrated in FIG. 1. Dispensing device 3 include a dispensing nozzle body 4, an electrically insulating holder 5, a coating fluid supply line 6 in communication with a coating fluid reservoir (not shown), and an electrical connection 7 to which a wire 8 is affixed. Dispensing nozzle body 4 comprises an electrically conductive, solvent-resistant material, preferably an easily cleaned material such as stainless steel. A commercially available stainless steel nozzle may be suitably adapted for use in the present invention with relatively minor modifications, such as the attachment of a conductive flange to which a wire from a high voltage source may be attached.

Insulating holder 5, which may be a plastic ring, holds nozzle body 4 and prevents conduction of electricity from nozzle body 4 to ground when the nozzle is energized by the second electrical potential. Coating fluid supply line 6 cooperates with an internal nozzle passage 11 (shown in FIG. 2) to supply coating fluid from the fluid reservoir to fluid nozzle orifice 9 facing target 1. When the second electrical potential is applied through wire 8 from a voltage source (not shown), potential is conducted from wire 8 onto nozzle body 4 via electrical connection 7, which may be affixed to the nozzle body by any electrically conductive means, such as welding or securing with a fastener.

As the coating fluid passes through nozzle passage 11, the second potential imparts a charge to the coating fluid. The charged coating fluid is attracted toward target stent 1, which is being held at an opposite potential than nozzle body 4. When the charged coating fluid leaves fluid nozzle orifice 9, the electrostatic attraction of the coating fluid spray 10 to target 1 tends to cause the charged coating fluid spray particles to travel towards target 1. A potential difference between nozzle body 4 and target holder 2 in the range of 2000 Volts to 40,000 Volts is sufficient for efficient transfer of coating fluid from nozzle body 4 to target stent 1. One skilled in the art will appreciate that the separation distance between the nozzle body 4 and stent 1 varies with the size of the stent and voltage. The distance between the fluid nozzle orifice and the target may be maintained over a broad range, as the voltage difference driving the electrostatic discharge of coating fluid toward the target may be readily adjusted to ensure the coating fluid reaches the target with a desired coating efficiency.

Figure 2:
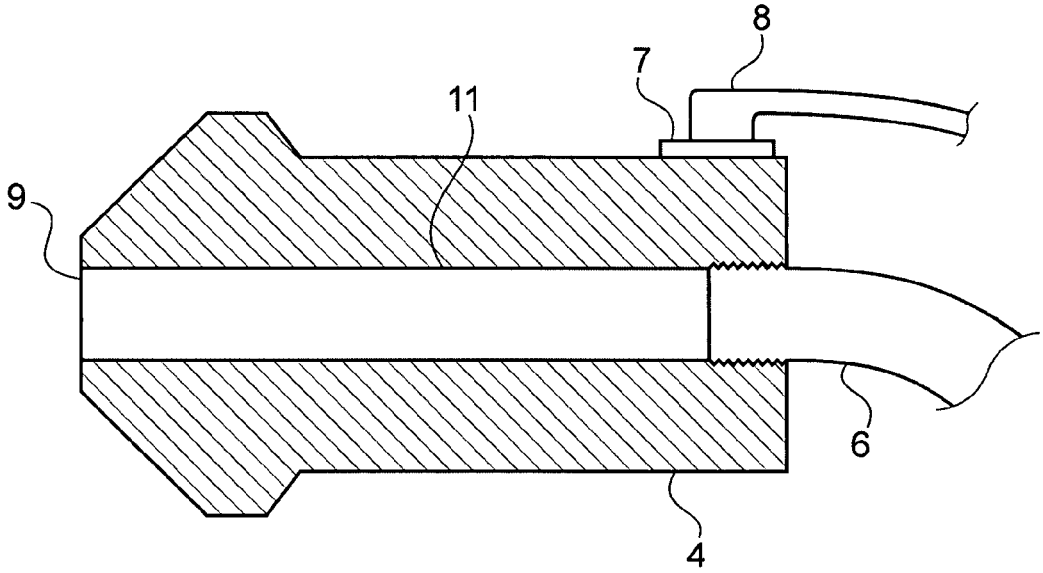
FIG. 2 is a schematic cross-section view of the electrostatic spray coating fluid delivery apparatus dispensing nozzle of FIG. 1.

As shown in the cross-section view of dispensing nozzle 4 in FIG. 2, fluid nozzle orifice 9 communicates with coating fluid supply line 6 via internal nozzle passage 11. The present electrically conductive nozzle permits the generation of higher charge densities in the coating fluid, thereby increasing the electrostatic attraction of the charged coating fluid particles toward target stent 1 and reducing coating waste.

Figure 3:
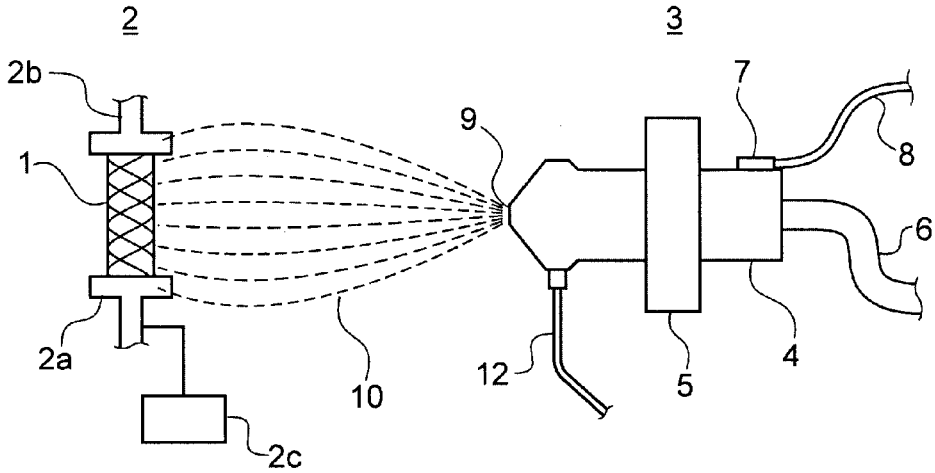
FIG. 3 is a schematic view of a second embodiment of an electrostatic spray coating fluid delivery apparatus in accordance with the present invention.
Figure 4:
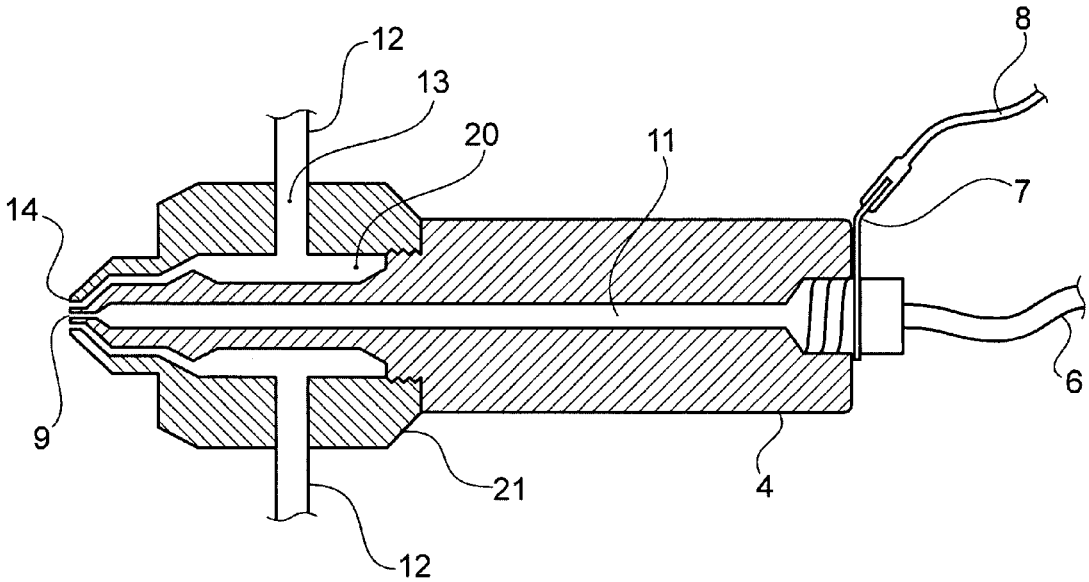
FIG. 4 is a schematic cross-section view of the electrostatic spray coating fluid delivery apparatus dispensing nozzle of FIG. 3.

In a second exemplary embodiment, smaller, more eletrostatically attractive charged particles may be obtained by injecting a gas (e.g. air) into atomization passageway 20, positioned adjacent nozzle internal passage 11. FIGS. 3 and 4 illustrate the apparatus of FIGS. 1 and 2, further equipped with at least one air supply line 12. Similar elements are numbered in the same manner as in FIGS. 1 and 2. Air supply line 12 provides pressurized air to atomization passageway 20. The pressurized air enhances atomization of the charged coating fluid as the fluid emerges from the fluid nozzle orifice 9. As shown in nozzle cross-section FIG. 4, air supplied from air supply line 12 may be injected via air passage 13 into the atomization passageway 20, adjacent nozzle internal passage 11, and toward an air atomization nozzle orifice 14. The air is ejected from atomization orifice 14, which creates a low-pressure region created by the high velocity air annulus surrounding fluid nozzle orifice 9, from which charged coating fluid is dispensed. The charged coating material is atomized and entrained within the air annulus airflow and electrostatically sprayed onto stent 1. One skilled in the art can appreciate that a variety of gases may be used and pressurized to enhance atomization and discharge of the coating material from the fluid nozzle orifice.

One skilled in the art can appreciate that a variety of designs exist for electrical connection 7 and dispensing nozzle body 4. For example, electrical connection 7 may be a conductive metallic nut or plate as depicted in FIGS. 1–3, or a conductive metallic flange as illustrated in FIG. 4. Also, dispensing nozzle body 4 may be a two-piece threaded body as depicted in FIG. 4, wherein the nozzle body 4 includes a threaded annular ring 21, or be a unitary body design (not shown) with nozzle internal passage 11 and atomization passageway 20 cast or machined therein. Further, dispensing nozzle body 4 may be a three-piece threaded body (not shown) for manufacturing ease having a separate threaded atomization nozzle orifice 14. Although FIG. 3 illustrates an embodiment with one air supply line 12 and FIG. 4 shows at least two air supply lines 12, one of skill in the art can also appreciate that more than two air supply lines may be used. Multiple air supply lines would permit electrostatic operation at lower system pressures.

Because the charge density of the coating fluid is higher than in internal electrode-type nozzles (due to the greater electrode surface area available in the present conductive nozzle), the smaller fluid particles each have a relatively high charge state despite their small size. Given their high charge state and low mass, the smaller coating fluid particles may be more efficiently electrostatically accelerated toward target stent 1, resulting in a higher fraction of the coating fluid emerging from fluid nozzle orifice 9 striking and adhering to target stent 1 than with previous internal electrode nozzle designs. Accordingly, a lower fraction of the coating fluid passes beyond target stent 1, further reducing coating fluid waste.

The coatings described in the foregoing discussion may include therapeutic agents. The term "therapeutic agent" as used herein includes one or more "therapeutic agents" or "drugs". The terms "therapeutic agents" and "drugs" are used interchangeably herein and include pharmaceutically active compounds, nucleic acids with and without carrier vectors such as lipids, compacting agents (such as histones), virus (such as adenovirus, andenoassociated virus, retrovirus, lentivirus and α-virus), polymers, hyaluronic acid, proteins, cells and the like, with or without targeting sequences.

Specific examples of therapeutic agents used in conjunction with the present invention include, for example, pharmaceutically active compounds, proteins, cells, oligonucleotides, ribozymes, anti-sense oligonucleotides, DNA compacting agents, gene/vector systems (i.e., any vehicle that allows for the uptake and expression of nucleic acids), nucleic acids (including, for example, recombinant nucleic acids; naked DNA, cDNA, RNA; genomic DNA, cDNA or RNA in a non-infectious vector or in a viral vector and which further may have attached peptide targeting sequences; antisense nucleic acid (RNA or DNA); and DNA chimeras which include gene sequences and encoding for ferry proteins such as membrane translocating sequences ("MTS") and herpes simplex virus-1 ("VP22")), and viral, liposomes and cationic and anionic polymers and neutral polymers that are selected from a number of types depending on the desired application. Non-limiting examples of virus vectors or vectors derived from viral sources include adenoviral vectors, herpes simplex vectors, papilloma vectors, adeno-associated vectors, retroviral vectors, and the like. Non-limiting examples of biologically active solutes include anti-thrombogenic agents such as heparin, heparin derivatives, urokinase, and PPACK (dextrophenylalanine proline arginine chloromethylketone); antioxidants such as probucol and retinoic acid; angiogenic and anti-angiogenic agents and factors; anti-proliferative agents such as enoxaprin, angiopeptin, rapamycin, angiopeptin, monoclonal antibodies capable of blocking smooth muscle cell proliferation, hirudin, and acetylsalicylic acid; anti-inflammatory agents such as dexamethasone, prednisolone, corticosterone, budesonide, estrogen, sulfasalazine, acetylsalicylic acid, and mesalamine; calcium entry blockers such as verapamil, diltiazem and nifedipine; antineoplastic/antiproliferative/anti-mitotic agents such as paclitaxel, 5-fluorouracil, methotrexate, doxorubicin, daunorubicin, cyclosporine, cisplatin, vinblastine, vincristine, epothilones, endostatin, angiostatin and thymidine kinase inhibitors; antimicrobials such as triclosan, cephalosporins, aminoglycosides, and nitrofurantoin; anesthetic agents such as lidocaine, bupivacaine, and ropivacaine; nitric oxide (NO) donors such as linsidomine, molsidomine, L-arginine, NO-protein adducts, NO-carbohydrate adducts, polymeric or oligomeric NO adducts; anticoagulants such as D-Phe-Pro-Arg chloromethyl ketone, an RGD peptide-containing compound, heparin, antithrombin compounds, platelet receptor antagonists, anti-thrombin antibodies, anti-platelet receptor antibodies, enoxaparin, hirudin, Warfarin sodium, Dicumarol, aspirin, prostaglandin inhibitors, platelet inhibitors and tick antiplatelet factors; vascular cell growth promotors such as growth factors, growth factor receptor antagonists, transcriptional activators, and translational promotors; vascular cell growth inhibitors such as growth factor inhibitors, growth factor receptor antagonists, transcriptional repressors, translational repressors, replication inhibitors, inhibitory antibodies, antibodies directed against growth factors, bifunctional molecules consisting of a growth factor and a cytotoxin, bifunctional molecules consisting of an antibody and a cytotoxin; cholesterol-lowering agents; vasodilating agents; agents which interfere with endogeneus vascoactive mechanisms; survival genes which protect against cell death, such as anti-apoptotic Bcl-2 family factors and Akt kinase; and combinations thereof. Cells can be of human origin (autologous or allogenic) or from an animal source (xenogeneic), genetically engineered if desired to deliver proteins of interest at the insertion site. Any modifications are routinely made by one skilled in the art.

Polynucleotide sequences useful in practice of the invention include DNA or RNA sequences having a therapeutic effect after being taken up by a cell. Examples of therapeutic polynucleotides include anti-sense DNA and RNA; DNA coding for an anti-sense RNA; or DNA coding for tRNA or rRNA to replace defective or deficient endogenous molecules. The polynucleotides can also code for therapeutic proteins or polypeptides. A polypeptide is understood to be any translation product of a polynucleotide regardless of size, and whether glycosylated or not. Therapeutic proteins and polypeptides include as a primary example, those proteins or polypeptides that can compensate for defective or deficient species in an animal, or those that act through toxic effects to limit or remove harmful cells from the body. In addition, the polypeptides or proteins that can be injected, or whose DNA can be incorporated, include without limitation, angiogenic factors and other molecules competent to induce angiogenesis, including acidic and basic fibroblast growth factors, vascular endothelial growth factor, hif-1, epidermal growth factor, transforming growth factor α and β, platelet-derived endothelial growth factor, platelet-derived growth factor, tumor necrosis factor α, hepatocyte growth factor and insulin like growth factor; growth factors; cell cycle inhibitors including CDK inhibitors; anti-restenosis agents, including p15, p16, p18, p19, p21, p27, p53, p57, Rb, nFkB and E2F decoys, thymidine kinase ("TK") and combinations thereof and other agents useful for interfering with cell proliferation, including agents for treating malignancies; and combinations thereof. Still other useful factors, which can be provided as polypeptides or as DNA encoding these polypeptides, include monocyte chemoattractant protein ("MCP-1"), and the family of bone morphogenic proteins ("BMP's"). The known proteins include BMP-2, BMP-3, BMP-4, BMP-5, BMP-6 (Vgr-1), BMP-7 (OP-1), BMP-8, BMP-9, BMP-10, BMP-11, BMP-12, BMP-13, BMP-14, BMP-15, and BMP-16. Currently preferred BMP's are any of BMP-2, BMP-3, BMP-4, BMP-5, BMP-6 and BMP-7. These dimeric proteins can be provided as homodimers, heterodimers, or combinations thereof, alone or together with other molecules. Alternatively or, in addition, molecules capable of inducing an upstream or downstream effect of a BMP can be provided. Such molecules include any of the "hedgehog" proteins, or the DNA's encoding them.

Coatings used with the present invention may comprise a polymeric material/drug agent matrix formed, for example, by admixing a drug agent with a liquid polymer, in the absence of a solvent, to form a liquid polymer/drug agent mixture. Curing of the mixture typically occurs in-situ. To facilitate curing, a cross-linking or curing agent may be added to the mixture prior to application thereof. Addition of the cross-linking or curing agent to the polymer/drug agent liquid mixture must not occur too far in advance of the application of the mixture in order to avoid over-curing of the mixture prior to application thereof. Curing may also occur in-situ by exposing the polymer/drug agent mixture, after application to the luminal surface, to radiation such as ultraviolet radiation or laser light, heat, or by contact with metabolic fluids such as water at the site where the mixture has been applied to the luminal surface. In coating systems employed in conjunction with the present invention, the polymeric material may be either bioabsorbable or biostable. Any of the polymers described herein that may be formulated as a liquid may be used to form the polymer/drug agent mixture.

The polymer used in the present invention is preferably capable of absorbing a substantial amount of drug solution. When applied as a coating on a medical device in accordance with the present invention, the dry polymer is typically on the order of from about 1 to about 50 microns thick. Very thin polymer coatings, e.g., of about 0.2–0.3 microns and much thicker coatings, e.g., more than 10 microns, are also possible. It is also within the scope of the present invention to apply multiple layers of polymer coating onto a medical device. Such multiple layers are of the same or different polymer materials.

The polymer of the present invention may be hydrophilic or hydrophobic, and may be selected from the group consisting of polycarboxylic acids, cellulosic polymers, including cellulose acetate and cellulose nitrate, gelatin, polyvinylpyrrolidone, cross-linked polyvinylpyrrolidone, polyanhydrides including maleic anhydride polymers, polyamides, polyvinyl alcohols, copolymers of vinyl monomers such as EVA, polyvinyl ethers, polyvinyl aromatics, polyethylene oxides, glycosaminoglycans, polysaccharides, polyesters including polyethylene terephthalate, polyacrylamides, polyethers, polyether sulfone, polycarbonate, polyalkylenes including polypropylene, polyethylene and high molecular weight polyethylene, halogenated polyalkylenes including polytetrafluoroethylene, polyurethanes, polyorthoesters, proteins, polypeptides, silicones, siloxane polymers, polylactic acid, polyglycolic acid, polycaprolactone, polyhydroxybutyrate valerate and blends and copolymers thereof as well as other biodegradable, bioabsorbable and biostable polymers and copolymers. Coatings from polymer dispersions such as polyurethane dispersions (BAYHDROL®, etc.) and acrylic latex dispersions are also within the scope of the present invention. The polymer may be a protein polymer, fibrin, collage and derivatives thereof, polysaccharides such as celluloses, starches, dextrans, alginates and derivatives of these polysaccharides, an extracellular matrix component, hyaluronic acid, or another biologic agent or a suitable mixture of any of these, for example. In one embodiment of the invention, the preferred polymer is polyacrylic acid, available as HYDROPLUS® (Boston Scientific Corporation, Natick, Mass.), and described in U.S. Pat. No. 5,091,205, the disclosure of which is hereby incorporated herein by reference. U.S. Pat. No. 5,091,205 describes medical devices coated with one or more polyisocyanates such that the devices become instantly lubricious when exposed to body fluids. In another preferred embodiment of the invention, the polymer is a copolymer of polylactic acid and polycaprolactone.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements. For example, the coating material may comprise a flowable solid material, such as a powder, in lieu of a fluid, as long as the flowable solid coating material can be reliably fed through the nozzle (for instance, via gravity feed) and accept a charge imparted by the second potential. The present invention is also suitable for use in a high speed automated medical device coating apparatus, wherein, for example, the voltage spike to remove the target oxide layer at the target holder/target interface points may be efficiently applied to the target as the target holder is travelling toward the coating spray station.

While the various elements of the disclosed invention are described and/or shown in various combinations and configurations, which are exemplary, other combinations and configurations, including more, less or only a single embodiment, are also within the spirit and scope of the present invention.

What is claimed is:

1. An apparatus for electrostatic spray application of a coating material to a target, comprising:

a target holder which holds a target at a first electrical potential;

a coating discharge nozzle body formed from an electrically conductive material, said nozzle having a nozzle orifice for discharging the coating material;

means for applying to the nozzle body a second electrical potential to electrostatically discharge the coating material from the orifice toward the target; and a spark discharge voltage generator;

wherein the spark discharge voltage generator is electrically connected to the target holder and generates a voltage spike sufficient to remove an oxide layer from at least one contact point of the target where the target contacts the target holder.

2. The electrostatic spray coating apparatus of claim 1, wherein, after the voltage spike is applied to the target holder, the target is electrically connected to a ground potential.

3. The electrostatic spray coating apparatus of claim 1, wherein the target is a medical device, and the coating material comprises a therapeutic agent.

4. The electrostatic spray coating apparatus of claim 3, wherein the medical device is a stent.

* * * * *